United States Patent [19]

McIntyre

[11] Patent Number: 5,074,758

[45] Date of Patent: Dec. 24, 1991

[54] SLURRY PUMP

[76] Inventor: Glover C. McIntyre, 743 Aspen Road, Pickering, Ontario, Canada, L1V 3P4

[21] Appl. No.: 276,344

[22] Filed: Nov. 25, 1988

[51] Int. Cl.[5] ..... F04F 1/06

[52] U.S. Cl. ..... 417/138; 417/139; 417/143; 417/900

[58] Field of Search ..... 417/101, 119, 120, 137, 417/138, 900, 130, 131, 145, 146, 147; 137/533.13, 533.15

[56] References Cited

U.S. PATENT DOCUMENTS

| | | | |
|---|---|---|---|
| 1,323,415 | 12/1919 | Sherbondy | 417/137 |
| 1,323,864 | 12/1919 | Human | 417/138 |
| 2,412,723 | 12/1946 | Elliott | 417/138 |
| 2,669,941 | 2/1954 | Stafford | 417/138 |
| 3,273,514 | 9/1966 | Bender | 417/137 |
| 3,352,248 | 11/1967 | Bender | 417/137 |
| 3,424,098 | 1/1969 | Bender | 417/137 |
| 3,606,585 | 10/1969 | Graves | 417/131 |
| 3,661,167 | 5/1972 | Hussey | 137/269 |
| 3,891,352 | 6/1975 | Tsukamoto | 417/101 |
| 3,991,825 | 11/1976 | Morgan | 417/118 |
| 4,021,447 | 5/1977 | Brekke | 417/143 |
| 4,536,131 | 8/1985 | Saito et al. | 417/102 |

OTHER PUBLICATIONS

"Plating Waste-Handling Sump Pump Wipes Out Rebuild Costs", Jim Wassilak, Jun. 1988, *Chemical Processing.*

*Primary Examiner*—Richard A. Bertsch
*Assistant Examiner*—Michael I. Kocharov

[57] ABSTRACT

A pump for liquid or slurry is valve controlled to fill a pumping chamber to an upper predetermined level; valve controlled to supply gas under pressure to the top of the liquid to force it out a lower outlet port down to a lower predetermined level and to alternate such cycles with all valves being located outside the chamber.

13 Claims, 1 Drawing Sheet

SLURRY PUMP

Figures 1, 2:
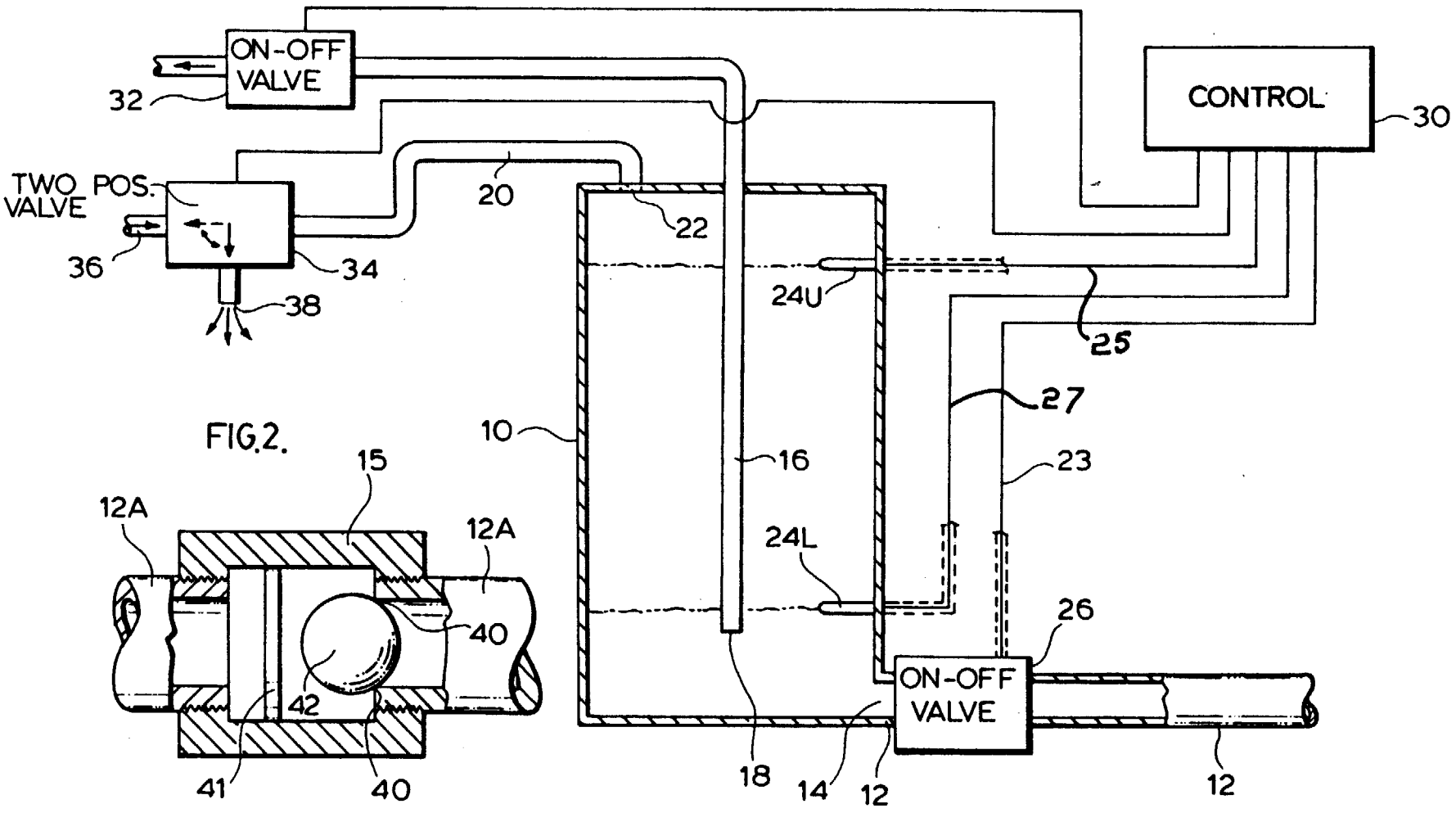

This invention relates to a pump for moving liquids or slurries which is particularly adapted to move dangerous and corrosive liquids.

By "liquid" herein I include both liquids and slurries.

The invention generally deals with pumps whose input line fills a chamber with liquid or slurry which has an upper outlet to an upper level and where a pressure gas source can be selectively opened to the chamber above the upper level to force the liquid or slurry out an output pipe until the liquid has reached a lower level of the chamber. The opening of the output pipe is below the lower level in the chamber. The sequential valving to cyclically allow filling the chamber to the upper level through the inlet, and emptying the chamber to the lower level through the outlet is controlled by valves and sometimes pistons and timing or sensing operations.

Pumps which include some of the features described in the previous paragraph have been described in patents known to applicant (all are U.S.)

U.S. Pat. No. 3,991,825 Morgan
U.S. Pat. No. 1,323,864 Human
U.S. Pat. No. 1,323,415 Sherbody
U.S. Pat. No. 3,273,514 Bender
U.S. Pat. No. 3,352,248 Bender
U.S. Pat. No. 3,424,098 Bender The above patents are intended to be arranged in approximate order of relevance to the invention disclosed herein. All patents teach the use of moving parts in the pumping chamber. Morgan's design for pumping viscous liquids shows the use of two valves and a free floating piston all operating within the pumping chamber.

With corrosive liquids the life of such moving parts in the pumping chamber is short and maintenance problems are large. Even with conventional liquids or slurries the problems of maintenance arise and this is made difficult if the parts to be replaced are contained in the pumping chamber.

It is an object of this invention to provide a pump suitable for corrosive or ordinary liquids or slurries wherein a pumping chamber contains an inlet port, a outlet port open below the intended lower level of liquid or slurry in the chamber and a pressurized gas inlet to the chamber above the intended upper level. Valves exterior to the chamber cycle between allowing the chamber to fill to the upper level and using pressurized gas to clear the chamber down to the lower level. There are no moving parts in the pumping chamber providing a pump which has a long service life and relatively low maintenance whether used with corrosive or ordinary liquids. Obviously valves are required to control the entrance and exit of liquid from the chamber and, if the liquid or slurry is corrosive, such valves may require frequent replacement. However located outside the pumping chamber such valves are relatively easy of access and easy to replace.

Cyclic means are provided for alternately (a) providing venting of the pumping chamber with the inlet open to provide liquid thereto while the outlet and the gas supply valve is closed and (b) closing the venting valve and the inlet valve while opening the outlet valve and the gas supply valve to pump a predetermined portion of the liquid in the chamber along the output line.

Preferably the pumping cycle is performed by providing sensors of the liquid level at the higher and lower levels. The sensor responsive to liquid dropping to the lower level actuates the four valves to initiate cycle (a) while the sensor responsive to liquid rising to the higher level actuates the four valves to initiate cycle (b). It follows that with such an arrangement that the pressure gas inlet port must be above the upper level and the outlet port must be below the lower level. It is noted that with such an arrangement the volume flow may be very accurately calculated by multiplying the volume between the upper and lower levels by the number of pumping cycles. It is also noted that any interruption or acceleration of flow is automatically taken care of because of the level sensor's control. Thus it is an alternate mode of operation, to use time cycles to alternate the (a), (b) cycles. However unequal or undetermined flow will occur if there are alterations in flow pressures or alterations as the constituency of the liquid, which may particularly be the case with a thick slurry.

In a preferred variant of the invention a two way valve is provided to combine the pressure supply and venting functions. In a first position, for the "fill" cycle (a), the pressure supply line is closed and the vent line is open and in a second position, for the "pump" cycle (b), the vent line is closed and the gas supply line is open.

The valves may be all power operated. However, the liquid output and liquid input valves may be ordinary one way valves since they are each subject to a higher upstream pressure when they are required to be open and to a higher downstream pressure when they are required to be closed.

Where one way valves are used, these are most suitable and inexpensive particularly where highly conosive liquids are used since there is little mechanism to protect or to fail. Where such one-way values are used, I prefer to use my particular design wherein the valve comprises a smaller upstream pipe coupled into a larger downstream pipe. A ball is designed to seal directly against the inner edges of the end of the smaller pipe when the downstream pressure is higher (cycle (a) for the liquid output valve and cycle (b) for the liquid input valve); and to move away from such edges to allow fluid flow where the upstream pressure is higher. Means are provided to prevent the escape of the ball when away from the pipe edges. By providing what is, in effect, a ball valve without a separate seat, applicant has a valve that is relatively inexpensive, maintenance free and easy to replace. With such a valve a compromise must be found between a smaller ball size which provides a good closure and clearance for liquid flow when open and which extends well into the smaller pipe and thus has a tendency to become wedged or stuck, and a larger ball which protrudes less deeply into the smaller pipe and thus does not get stuck, but in open position leaves less clearance for liquid passage. I have found that the best compromise is when the ball extends into the pipe about a quarter of the ball diameter, in sealing position, meeting the edges at a ball tangential angle of about 60° to the flow axis.

In drawings which illustrate a preferred embodiment of the invention:

FIG. 1 is a view partially schematic and partially in vertical section showing the invention; and FIG. 2 is a section of a one way valve for use with the invention.

In FIG. 1 a chamber 10 is sealed with the exception of the inlet and outlet ports described hereafter.

Inlet line 12 extends to input port 14 toward the bottom of the chamber. Outlet line 16 extends downwardly from the top of the container to an outlet port 18 near the bottom of the chamber. Line 20 extends to port 22 at the top of the container. Probe 24U defines an upper liquid level for the container and probe 24L a lower one. Port 22 must be located above 24U. Probe 24L must be located above the outlet port 18.

Line 12 is provided with valve 26 for controlling the flow therethrough from a pressurized source of liquid, not shown with the valve selectively assuming an ON or OFF setting responsive to a signal received along line 23 from a control 30. Line 16 carries liquid from the chamber to a storage area or other device and is provided with a valve 32 for selectively assuming an ON and OFF setting. Line 20 extends from two position valve 34 to the outlet port 22. Line 36 extends from a pressurized gas source not shown (such gas will commonly be steam, compressed air or compressed nitrogen)to valve 34. Valve 34 is also connected to port 38 vented to atmosphere. Valve 34 is of conventional design and is designed in one position (cycle (a)) to connect the portion of chamber 10 above 24U to atmosphere at port 38 while closing the connection from compressed air line 36 and in its other position (cycle (b)) to connect the compressed air line 36 to port 22 while closing off the connection to atmosphere.

Valves 26 and 32 may be of any conventional type and operated in any conventional manner, e.g. by solenoid operation by the control 30. Probes 24U and 24L sense the liquid level in any desired conventional manner and transmit sensing signals along lines 25 and 27, respectively to the control. However, it is preferred to use tuning fork type level sensors whose frequency alters when immersed or not in liquid.

Responsive to the sensed level drop to level 24L the control is designed in accord with any one of a number of conventional designs to operate valve 26 to ON and valve 32 to OFF and valve 34 to 'vent' position.

Under cycle (a) the liquid is supplied under pressure along line 12 to fill the chamber to level 24U while the air being driven out of the chamber is vented to the atmosphere through valve 34. When the liquid reaches sensor 24U this is sensed by that sensor and the resulting signal to the control causes the control to initiate phase (b): closing valve 26 to OFF, opening valve 32 to ON and switching valve 34 from 'vent' to 'supply' causing compressed gas to enter the chamber through port 22.

In operation then the compressed gas enters the chamber and drives the liquid downwardly outside of and up the outlet line 16 to its destination until the liquid reaches level 24L at which time sensor 24L signals the controller to reinitiate cycle (a).

The pump as shown may be adapted for immersion in a tank of liquid to be pumped. Then immersed line 12 is open to the liquid near the bottom of the tank and the liquid pressure along line 12 is supplied by gravity. Control lines 23, 25 and 27 from valve 26 and sensors 24U and 24L and the connected members are encapsulated or sheathed for protection.

The pump shown in FIG. 1 may be connected in parallel with a similar pump for smoother flow or connected in tandem if sequential pumping stages are required.

The pump shown in FIG. 1 shows controlled valves 26 and 32. However, it should be noted that such controls are not necessarily required since in most applications valves 26 and 32 may be simple one way valves without control connections.

In operation with such one way valves when the liquid level reaches 24L this is sensed and valve 34 is switched from 'supply' to 'vent'. The venting removes any motive pressure on the liquid in the tank, hence one way valve 32 has higher pressure on the downstream side and closes to OFF. However, the venting also produces a higher pressure on the upstream side of one way valve 26 moving it to ON and causing the liquid under its exterior pressure to fill the tank. When the liquid level rises to 24U, sensor 24U switches valve 34 (only) from 'vent' to 'supply' to initiate cycle (b). The chamber vent is now closed and the compressed gas supply through valve 34 creates a pressure in the liquid causing valve 32 to open and valve 26 to close. (Operation in this manner requires that the pressure due to the compressed gas be greater than that exerted on the liquid through valve 26 but this will be the case in most instances.) When the liquid in the tank reaches level 24U the control again switches valve 34 from 'supply' to 'vent' and phase (a) is again initiated.

Where one way valves are used I prefer to use my own valve for economy, and efficiency of maintenance. See FIG. 2. In my preferred development the supply line is a pipe provided with a normally coupled portion 15 of wider diameter which overlaps the upstream and downstream ends of the smaller pipe. The inner edges 40 of smaller pipe ends at the upstream end, form themselves the valve seat, and no separate valve seat in provided. The ball 42 must be dimensioned to seat directly on the edges of the upstream inner pipe and seal it when the downstream pressure is higher. The ball is maintained in the vicinity of the inner pipe by any conventional keeper such as a small diameter rod 41 attached to the inner pipe to stop down stream progress of the ball when it is far enough from its seat to allow passage of liquid (which may be a thick slurry) past the ball 42. The ball must be small enough to allow passage of liquid thereabout in its travel downstream when the valve is open but not so small as to have a tendency to stick in the smaller pipe after closure of the valve. I have found the best design compromise is reached when the ball dimension is such that about $\frac{1}{4}$ of the diameter is received in the smaller pipe in the closed position of the valve, that is the diameter of the ball is about $\sqrt{3}$ times the diameter of the smaller pipe.

Instead of sensing the liquid levels, the sensors 24L and 24U may be omitted and the valves 26, and 32, and 34 (where all valves are controlled) or valve 34 (where only this valve is controlled) may be operated to alternate between cycles (a) and (b) on a timed cycle and this is within the scope of the invention. However using a timing cycle renders the operation subject to liquid or compressed gas pressure and to change in consistency in the liquid. Thus the desired high and low levels may not be exactly reached and operation with some liquids (including thick slurries) less predictable. Also flow rates cannot be calculated merely by counting pumping cycles and must be otherwise determined.

I claim:

1. Pump for slurries having a pumping chamber having a pre-determined upper and lower level for such slurry therein, comprising slurry inlet port to said chamber, slurry outlet port from said chamber located below said lower level, gas inlet port for pressurized gas located above the upper level, inlet valve means located outside said chamber for controlling flow to said slurry inlet port, outlet valve means located outside said chamber for controlling flow from said slurry inlet port, outlet valve means located outside said chamber for controlling flow from said slurry outlet port, valve means located outside said chamber for controlling the flow of pressurized gas to said gas inlet port, venting valve means located outside said chamber for selectively allowing or preventing the escape of gas from said chamber, first and second stationary means independent of the conductivity or constituence of said slurry, first said stationary means, located in said chamber, for sensing the presence of slurry at said upper level;

first second stationary means, located in said chamber, for sensing the absence of slurry above said lower level;

means cooperating with said sensing means for cyclically operating each of said valve means:

(a) responsive to the detection by said second means of the absence of slurry above said lower level, to close said slurry outlet valve and said gas inlet valve means and open said venting valve means and slurry inlet valve means to fill said chamber to said upper, then, (b) responsive to the detection by said first means of the presence of slurry at said upper level, to close said slurry inlet valve means and said venting valve means and open said slurry outlet valve and said gas inlet valve to empty said chamber.

2. Pump as claimed in claim 1 wherein: said gas inlet port also serves as a venting outlet port, a two position valve combines the function of the gas inlet valve and of the venting valve whereby in one position of said two position said venting outlet is closed and gas is allowed to enter said chamber and in the other position of the two position valve gas is stopped from entering said chamber and said chamber is vented to the atmosphere.

3. Pump as claimed in claim 2 herein said liquid inlet and outlet valves are composed of an inner pipe coupled to and overlapping with an outer pipe, the end of the inner pipe facing in the downstream direction and defining inner corners; a ball, shaped to seal directly against the inner corners of the end of the inner pipe, when downstream pressure is higher than upstream and means downstream from said inner pipe to maintain said ball in the vicinity of said inner corners when moved away from said corners by a higher upstream pressure.

4. Pump as claimed in claim 3 wherein said ball is shaped to seal against said corners with about ¼ of the diameter upstream thereof.

5. Pump as claimed in claim 2 wherein said liquid outlet conduit is arranged to extend downwardly through said liquid to said outlet port.

6. Pump as claimed in claim 5 herein said liquid inlet and outlet valves are composed of an inner pipe coupled to and overlapping with an outer pipe, the end of the inner pipe facing in the downstream direction and defining inner corners; a ball, shaped to seal directly against the inner corners of the end of the inner pipe, when downstream pressure is higher than upstream and means downstream from said inner pipe to maintain said ball in the vicinity of said inner corners when moved away from said corners by a higher upstream pressure.

7. Pump as claimed in claim 6 where said ball is shaped to seal against said corners with about ¼ of the diameter upstream thereof.

8. Pump as claimed in claim 1 herein said liquid inlet and outlet valves are composed of an inner pipe coupled to and overlapping with an outer pipe, the end of the inner pipe facing in the downstream direction and defining inner corners; a gall, shaped to seal directly against the inner corners of the end of the inner pipe, when downstream pressure is higher than upstream and means downstream from said inner pipe to maintain said ball in the vicinity of said inner corners when moved away from said corners by a higher upstream pressure.

9. Pump as claimed in claim 8 wherein said ball is shaped to seal against said corners with about ¼ of the diameter upstream thereof.

10. Pump as claimed in claim 1 wherein said liquid outlet conduit is arranged to extend downwardly through said liquid to said outlet port.

11. Pump as claimed in claim 10 wherein said liquid inlet and outlet valves are composed of an inner pipe coupled to and overlapping with an outer pipe, the end of the inner pipe facing in the downstream direction and defining inner corners; a ball, shaped to seal directly against the inner corners of the end of the inner pipe, when downstream pressure is higher than upstream and means downstream from said inner pipe to maintain said ball in the vicinity of said inner corners when moved away from said corners by a higher upstream pressure.

12. Pump as claimed in claim 11 where said ball is shaped to seal against said corners with about ¼ of the diameter upstream thereof.

13. Method of pumping slurries comprising:

providing a pumping chamber having a pre-determined upper and lower level for such slurry therein, having:

a slurry input port for the supply of slurries to said chamber, a slurry output port from said chamber located below said lower level, a gas input port located above the upper level alternately performing the steps (a) and (b);

(a) sensing the absence of slurry at said lower level, closing a slurry outlet valve and a gas supply valve each of which are located outside said chamber, in order to prevent flow of slurry through said slurry outlet port and flow of gas in said gas inlet port and, at substantially the same time causing the escape of gas from said chamber and the supply of slurry to said chamber through said slurry inlet port by control of a slurry inlet valve located outside said chamber: to fill said chamber to said upper level;

(b) sensing the presence of slurry at said upper level in said chamber responsive to the sensing of the presence of slurry at said upper level at substantially the same time: terminating flow of slurry into said chamber by closing said slurry inlet valve, preventing the escape of gas from said chamber, allowing flow of slurry out of said chamber by opening said slurry outlet valve, opening said gas inlet valve and supply pressurized gas therethrough; to empty said chamber to said lower level wherein said levels are each sensed by stationary sensing means independent of the conductivity or constituency of said slurry.

* * * * *